US007278822B2

(12) United States Patent
Stanzel

(10) Patent No.: US 7,278,822 B2
(45) Date of Patent: Oct. 9, 2007

(54) TURBOMOLECULAR PUMP

(75) Inventor: Joerg Stanzel, Wetzlar (DE)

(73) Assignee: Pfieffer Vacuum GmbH, Asslar (DE)

( * ) Notice: Subject to any disclaimer, the term of this patent is extended or adjusted under 35 U.S.C. 154(b) by 448 days.

(21) Appl. No.: 10/890,730

(22) Filed: Jul. 14, 2004

(65) Prior Publication Data

US 2005/0013710 A1 Jan. 20, 2005

(30) Foreign Application Priority Data

Jul. 15, 2003 (DE) ..... 103 31 932

(51) Int. Cl.
*F04D 29/40* (2006.01)

(52) U.S. Cl. ..... 415/199.5; 415/209.1; 415/214.1; 415/220

(58) Field of Classification Search ..... 415/90, 415/143, 189, 190, 193, 199.5, 209.1, 209.2, 415/209.3, 209.4, 210.1; 417/423.4; 403/257, 403/263, 327, 329

See application file for complete search history.

(56) References Cited

U.S. PATENT DOCUMENTS 1,288,360 A * 12/1918 Zaar ..... 415/193
2,610,786 A * 9/1952 Howard ..... 415/209.1
3,032,260 A * 5/1962 Latham ..... 415/190
4,832,564 A * 5/1989 Holss et al. ..... 415/90
5,052,887 A * 10/1991 Novikov et al. ..... 415/90
6,332,752 B2 * 12/2001 Ikegami et al. ..... 415/90
6,461,123 B1 10/2002 Lotz
6,503,050 B2 * 1/2003 Reimer et al. ..... 415/90
2001/0019694 A1 * 9/2001 Blecker et al. ..... 415/90

FOREIGN PATENT DOCUMENTS

DE 3402549 A1 * 8/1985 ..... 415/90
DE 29717764 1/1998
DE 199 51 954 A1 * 5/2001
DE 10010371 9/2001
JP 57-212395 A * 12/1982 ..... 415/90

* cited by examiner

*Primary Examiner*—Ninh H. Nguyen
(74) *Attorney, Agent, or Firm*—Abelman, Frayne & Schwab

(57) ABSTRACT

A turbomolecular pump includes a plurality of rotor and stator discs arranged alternatively one behind another and producing together a pumping effect, a plurality of spacer rings for retaining the stator discs at a distance from each other; and connection elements for fixedly connecting adjacent spacer rings with each other, so that the spacer rings together provide for securing and centering of the stator discs, taking over the function of a pump housing that is eliminated.

3 Claims, 3 Drawing Sheets

TURBOMOLECULAR PUMP

BACKGROUND OF THE INVENTION

1. Field of the Invention

The present invention relates to a turbomolecular pump including a plurality of rotor and stator discs arranged alternatively one behind another and producing together a pumping effect, and a plurality of spacer rings for retaining the stator discs at a distance from each other.

2. Description of the Prior Art

The pump of the type discussed above has pumping active elements formed of rotor and stator discs provided with vanes and arranged alternatively one behind another. The rotor and stator discs generally are provided each with a support ring with vanes provided on the ring outer sides. The vanes, which are provided on the rotor discs rotate with a high speed and produce, together with the stator vanes, the pumping effect. The stator discs are retained at a distance from each other with spacer rings arranged at outer circumferences of the stator discs. The distance between separate stator discs is so selected that the rotor discs can rotate therebetween without contacting the same. The stator discs, together with the spacer rings, form the stator. The stator is centered by an inner wall of the pump housing. Such an assembly with stator discs, spacer rings, and a housing is disclosed in German Patent No. 3,722,164.

The drawback of the turbomolecular pump of the type disclosed in the German Patent consists in a large number of components which makes the construction of the pump rather complicated. Moreover, the pump has a rather rigid construction which makes the adaptation of the pump to the requirements of a particular usage rather difficult.

German Publication DE 19951954, which corresponds to U.S. Pat. No. 6,461,123, discloses a turbomolecular pump with a reduced number of components. In this turbomolecular pump, each stator disc, a respective spacer ring, and a section of the pump housing are formed as a one-piece part. However, a drawback of this construction consists in that additional parts are needed for securing and holding together separate stator components. The use of additional parts complicates the assembly of the turbomolecular pump and require additional space.

Accordingly, an object of the present invention is to provide a turbomolecular pump having a reduced number of components in comparison with known turbomolecular pumps.

Another object of the present invention is to provide a turbomolecular pump characterized by reduced manufacturing costs and a simplified assembly.

A further object of the present invention is to provide a turbomolecular pump that can be easily integrated into different systems and, thus, can be easily adapted to particular usage.

SUMMARY OF THE INVENTION

These and other objects of the present invention are achieved by providing a turbomolecular pump of the type described above and including means for fixedly connecting adjacent spacer rings with each other, so that the spacer rings together provide for securing and centering of the stator discs.

The present invention permits to substantially reduce the number of pump components which reduces manufacturing costs and simplifies the pump assembly. The spacer rings are so connected with each other that they take over the function of the pump housing of securing the stator discs in place and centering the same. The other functions of the housing are taken over by sections of the recipient which is to be pumped out. This ensures an optimal adaptation of the pump and the recipient. As a result, it becomes possible to arranged the pumping active components in an immediate vicinity of an evacuation region. Because the spacer rings takeover of the functions of the pump housing, the housing as a separate component is eliminated.

The novel features of the present invention, which are considered as characteristic for the invention, are set forth in the appended claims. The invention itself, however both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
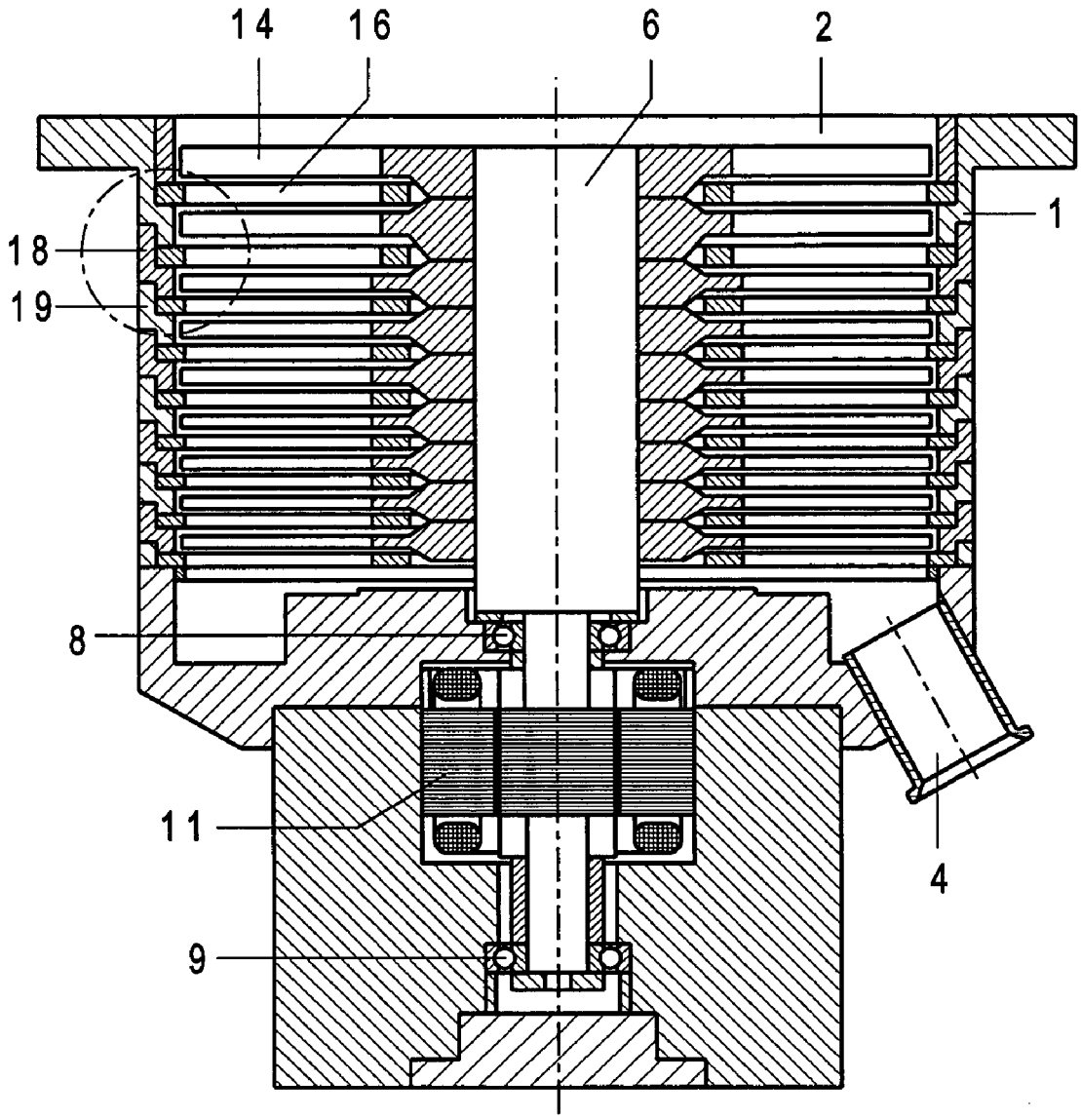
FIG. 1 a cross-sectional view of a turbomolecular pump according to the present invention.

A turbomolecular pump according to the present invention, which is shown in FIG. 1, has a housing 1 formed of spacer rings 18 and having a suction inlet opening 2 and a gas outlet opening 4. A rotor shaft 6 is supported in bearings 8 and 9 and is driven by a motor 11. A plurality of rotor discs 14 is secured on the rotor shaft 6. Stator discs 16 are arranged between the rotor discs 14 and are retained at a distance from each other by the spacer rings 18. The rotor discs 14 and the stator discs 16 are provided with a pumping active structure and together produce a pumping effect.

According to the present invention, the spacer rings 18 are assembled and connected with each other in such a way that they form the housing 1 of the pump. The spacer rings 18 are also used for securing and centering the stator discs 16.

Figure 2:
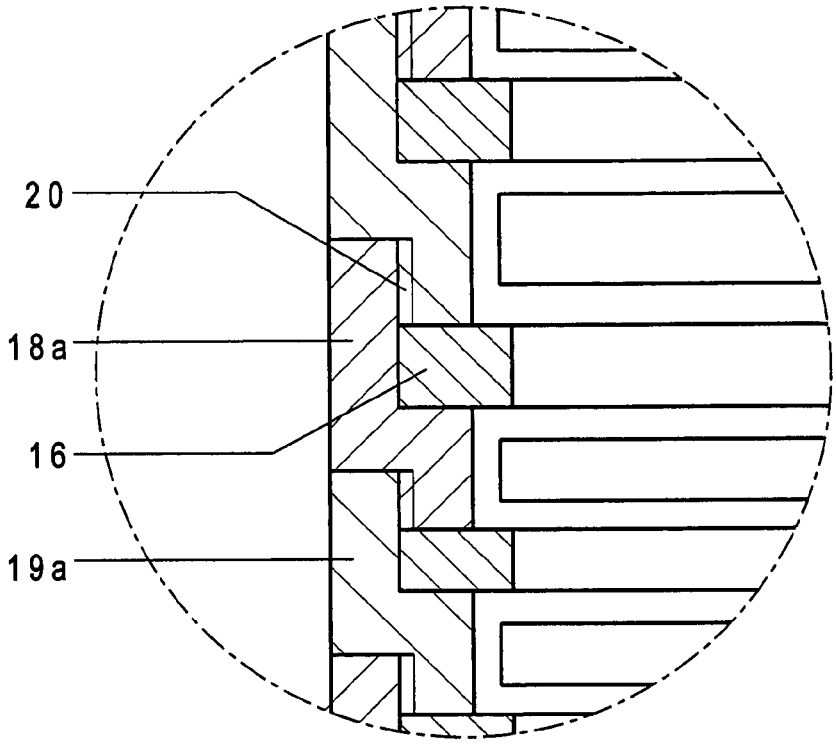
FIG. 2 a cross-sectional view illustrating first connection means for connecting spacer rings.

FIG. 2 shows two spacer rings 18*a* and 19*a* for securing a stator disc 16. At a location 20, the two rings are connected with each other by thread means.

Figure 3:
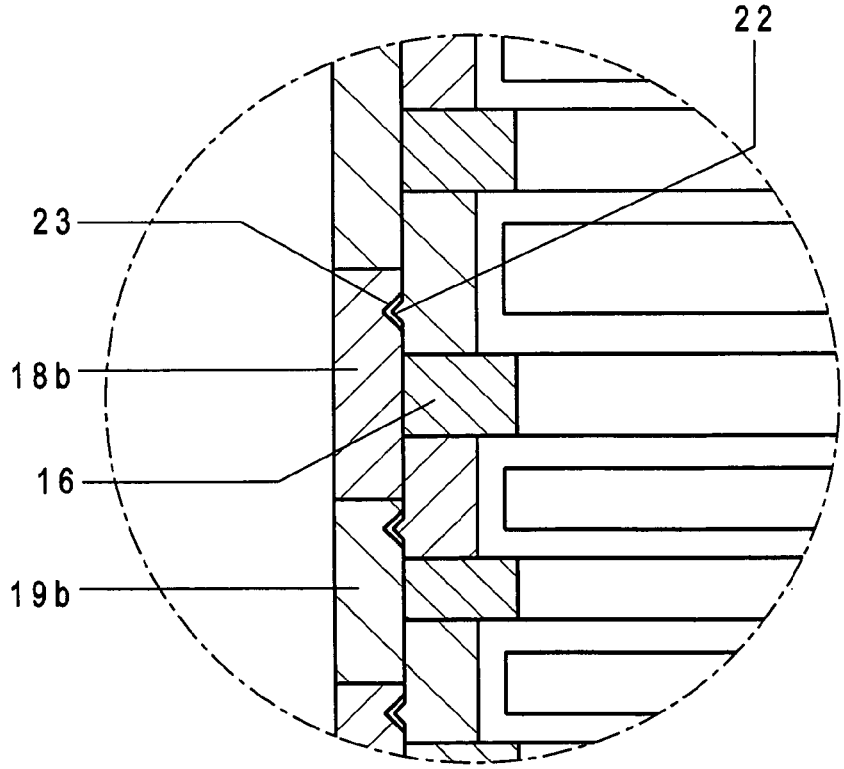
FIG. 3 a cross-sectional view illustrating second connection means for connecting spacer rings.

In FIG. 3, the two spacer rings 18 and 19*b*, with a stator disc 16, are secured with each other with clip means formed of a web 22 and a groove 23.

Figure 4:
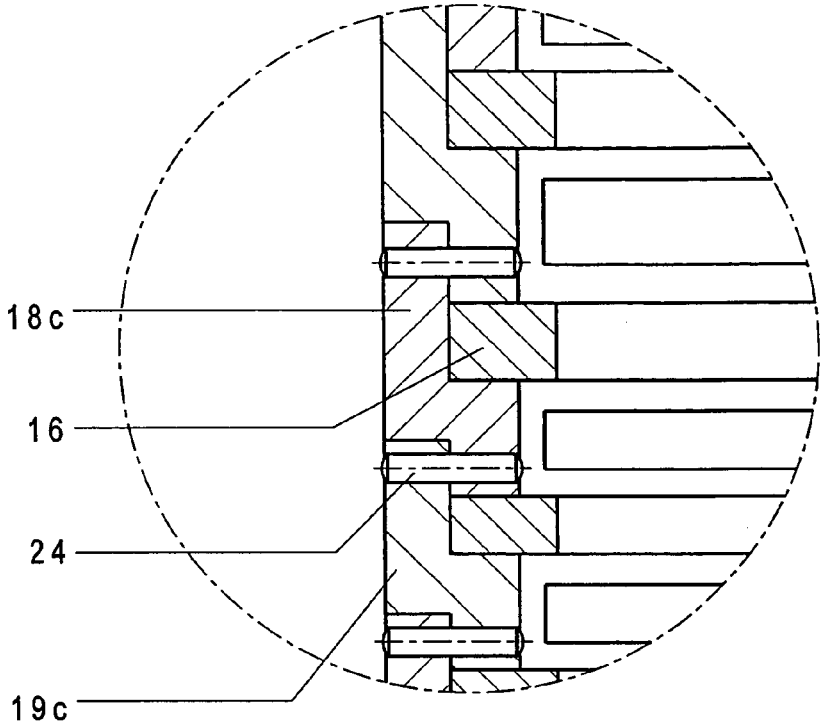
FIG. 4 a cross-sectional view illustrating third connection means for connecting spacer rings.

In FIG. 4, two spacer rings 18*c* and 19*c*, with a stator disc 16, are connected with each other by a pin 24.

Figure 5:
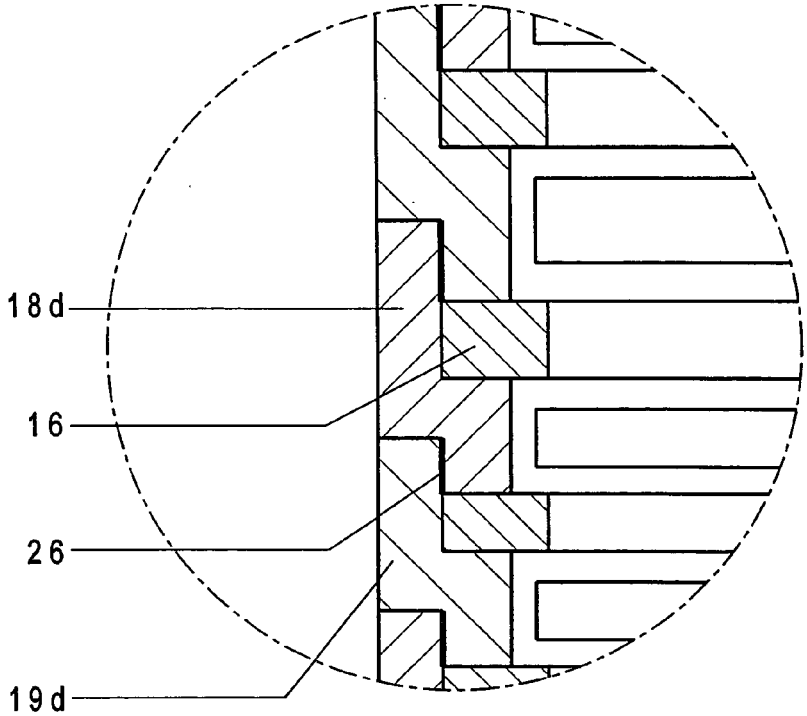
FIG. 5 a cross-sectional view illustrating fourth connection means for connecting spacer rings.

In FIG. 5, two spacer rings 18*d* and 19*d*, with a stator disc 16, are forcelockingly connected with each other at a location 26, by being pressed to each other.

The sealings between the spacer rings and the spacer rings and other pump components are not shown. For sealing, conventional arrangements such as shown, e.g., in U.S. Pat. No. 6,461,123 incorporated herein for reference thereto, can be used.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A turbomolecular pump, comprising a plurality of rotor discs and stator discs arranged alternatively one behind another and producing together a pumping effect; a plurality of spacer rings for retaining the stator discs at a distance from each other; and means for fixedly connecting adjacent spacer rings with each other, so that the spacer rings together provide for securing and centering of the stator discs, wherein the fixedly connecting means comprises a clip connection formed of a web (22) and a groove (23).

2. A turbomolecular pump, comprising a plurality of rotor discs and stator discs arranged alternatively one behind another and producing together a pumping effect; a plurality of spacer rings for retaining the stator discs at a distance from each other; and a plurality of means for fixedly connecting each pair of adjacent spacer rings independently form an adjacent pair of adjacent spacer rings with each other, so that the spacer rings together provide for securing and centering of the stator discs, wherein the fixedly connecting means comprises radially extending pin means.

3. A turbomolecular pump, comprising a plurality of rotor discs and stator discs arranged alternatively one behind another and producing together a pumping effect; a plurality of spacer rings for retaining the stator discs at a distance from each other; and a plurality of means for fixedly connecting each pair of adjacent spacer rings independently form an adjacent pair of adjacent spacer rings with each other, so that the spacer rings together provide for securing and centering of the stator discs, wherein the spacer rings form an entire pump housing.

* * * * *